US008629338B2

(12) United States Patent
Sterner et al.

(10) Patent No.: US 8,629,338 B2
(45) Date of Patent: Jan. 14, 2014

(54) BANJO TAILPIECE

(75) Inventors: Anders Sterner, Märsta (SE); Per Svalander, Uppsala (SE)

(73) Assignee: Anders Sterner, Märsta (SE)

( * ) Notice: Subject to any disclaimer, the term of this patent is extended or adjusted under 35 U.S.C. 154(b) by 31 days.

(21) Appl. No.: 13/489,783

(22) Filed: Jun. 6, 2012

(65) Prior Publication Data

US 2012/0312143 A1 Dec. 13, 2012

Related U.S. Application Data

(60) Provisional application No. 61/494,001, filed on Jun. 7, 2011.

(51) Int. Cl.
*G10D 3/12* (2006.01)

(52) U.S. Cl.
USPC ..... 84/300

(58) Field of Classification Search
USPC ..... 84/300
See application file for complete search history.

(56) References Cited

U.S. PATENT DOCUMENTS

| | | | | | |
|---|---|---|---|---|---|
| 1,182,687 | A | * | 5/1916 | Kershner | 84/300 |
| 1,367,526 | A | * | 2/1921 | Kirk | 84/300 |
| 1,462,359 | A | * | 7/1923 | Winship et al. | 84/300 |
| 1,566,745 | A | * | 12/1925 | Grover | 84/301 |
| 1,626,094 | A | * | 4/1927 | Page | 84/300 |
| 1,721,153 | A | * | 7/1929 | Grover et al. | 84/300 |
| D191,139 | S | * | 8/1961 | Winship et al. | D17/21 |
| 6,107,553 | A | | 8/2000 | Deering et al. | |
| 2002/0144585 | A1 | | 10/2002 | Potter | |
| 2012/0312143 | A1 | * | 12/2012 | Sterner et al. | 84/300 |

OTHER PUBLICATIONS

Sterner Banjo Tailpiece, viewed Aug. 23, 2013 at http://www.halmbocken.se/sterner/tailpiece/Tailpiece/Tailpiece.htm.*

Fults, F-Series and XYZ-Series Mounts, Apr. 8, 2010, downloaded from the Internet Jul. 1, 2012, http://web. archive.org/web/20100408235930/http://www.banjotailpiece.com/Mounting_page.html, Sep. 23, 2013.

* cited by examiner

*Primary Examiner* — Robert W Horn
(74) *Attorney, Agent, or Firm* — Potomac Patent Group PLLC

(57) ABSTRACT

A banjo tailpiece body formed in one single piece and having a fixation member engaging behind two rear, adjacent head-stretching hooks so as to enable a fixation of the tailpiece to the banjo only by the tension of the banjo strings.

5 Claims, 3 Drawing Sheets

BANJO TAILPIECE

BACKGROUND OF THE INVENTION

1. Field of the invention

The present invention relates to a tailpiece for a banjo, comprising:

a substantially L-shaped rigid member having a first, substantially planar plate portion and a second, substantially planar plate portion extending substantially normal to the first plate portion;

anchoring members on the L-shaped member for attachment of banjo strings to the tailpiece; and a fixation member at a distal end of the second plate portion for attachment of the tailpiece to a drum assembly of the banjo.

2. Related Art

A large variety of tailpieces for banjos is previously known and consists of many different components which make them expensive to manufacture. For example, the U.S. company Fults makes a banjo tailpiece which utilizes two rear head-stretching hooks for making the tailpiece laterally stable in its mounted position on the banjo. This tailpiece consists of a lower part which by means of screws is attached between two adjacent rear stretch hooks. Un upper movable part is fixated to this lower part over a hinge so that it can be adjusted by an adjustment screw. This Fults tailpiece consists of more than 20 components which makes it complicated and expensive.

More simple structures of banjo tailpieces are known from e.g. U.S. Pat. No. 6,107,553 and US 2002/0144585 A1. These tailpieces consist of only two parts, an L-shaped plate body with a connecting tab or a bottom portion, and a fixation screw which attaches the tailpiece to the banjo rim through a slot or aperture in the connecting tab. This type of tailpiece is not adjustable and not especially stable in its mounted position.

A banjo tailpiece should be adjustable in two ways. Firstly, it should be adjustable in height position in order to regulate the pressure of the strings on the bridge. This adjustment may improve the tone of the banjo. Secondly, it should also be adjustable laterally so that the strings will be located in an optimal position over the neck fingerboard of the banjo.

The stability of the tailpiece is of great importance for many reasons. It should be as rigid as possible in order to absorb a minimum of the vibration energy of the strings. This increases the sound volume. Also, it is important that the individual tensions of the strings do not affect one another. For example, when tuning a string, or if a string breaks, the tension in the other strings should not be affected.

Furthermore, it is desirable that changing the strings should be as easy and quick as possible.

SUMMARY OF THE INVENTION

It is an object of the present invention to provide a banjo tailpiece which improves the desired qualities mentioned above. In a basic, simplest embodiment of the tailpiece of the present invention, it consists of only one single component which is adjustable laterally. For this purpose the fixation member of the tailpiece set forth in the introduction comprises two legs extending laterally away from one another, each of said legs being provided with a free end section configured for engaging behind a respective one of two adjacent banjo head-stretching hooks, wherein the first and second plate portions and said fixation member being formed integrally into a rigid one-piece body. Such a banjo tailpiece is easy and inexpensive to manufacture and has unsurpassed stability owing to the fact that fixation points (the points of engagement of the free ends of the legs of the fixation member against and behind the stretching hooks) are spread widely apart. As the tension of the strings are utilised to fixate the tailpiece to the banjo, no other fastening means, such as bolts, nuts or screws are required.

Preferably, the free end section of the legs has a rear support surface for engagement with a respective stretching hook, and an upper support surface for engagement with a lower edge surface of a banjo head-mounting ring. This will stabilize the position of the tailpiece in its mounted state on the banjo.

To prevent the tailpiece from unintentionally being detached, the fixation members may have two substantially parallel side edge surfaces facing away from one another, the distance between which being less than the mutual free distance between the two adjacent stretching hooks behind which the fixation member of the tailpiece is to be mounted so as to allow for a lateral adjustment of the latter.

According to a further embodiment of the invention the second plate portion may be provided with a threaded hole for insertion of an adjustment screw for adjusting the vertical angle of the first plate portion of the tailpiece relative to the banjo head.

The tailpiece of the present invention will be described more in details below with reference to the attached drawings.

DETAILED DESCRIPTION OF PREFERRED EMBODIMENTS

Figure 1:
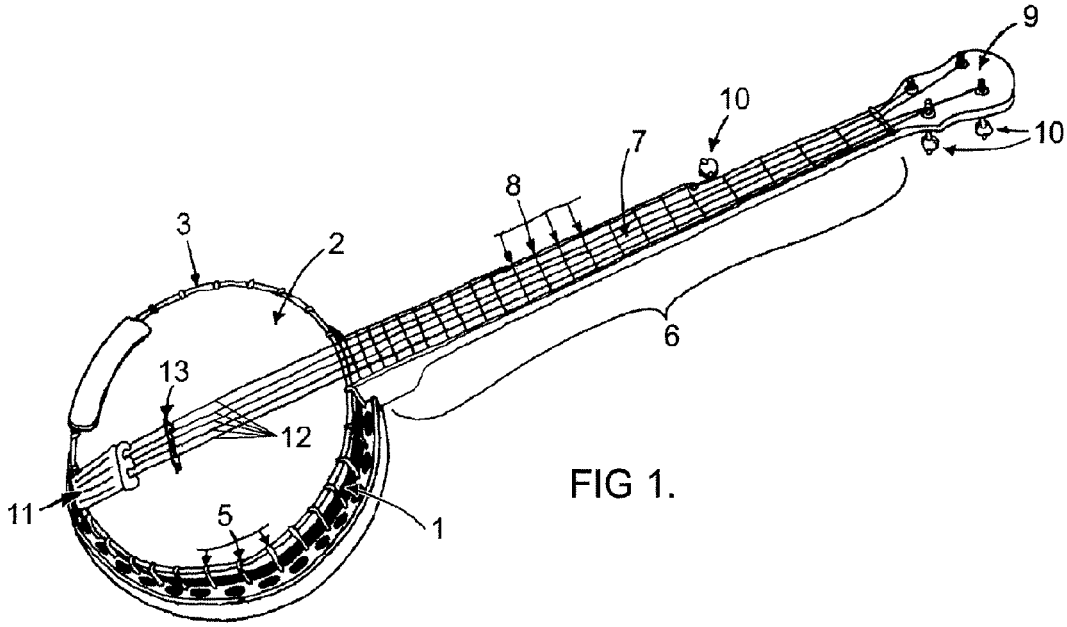
FIG. 1 illustrates a five string banjo in general.
Figure 2:
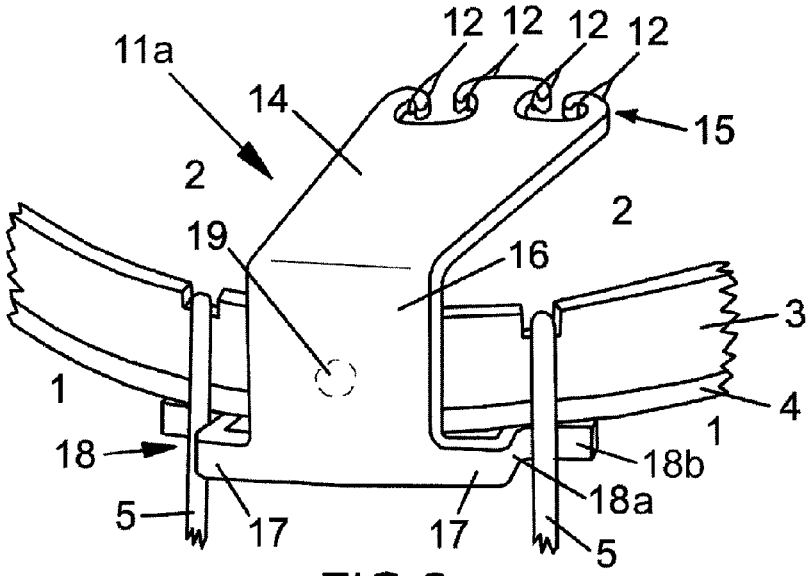
FIG. 2 is a perspective view of a first, basic embodiment of the tailpiece of the invention.
Figure 3:
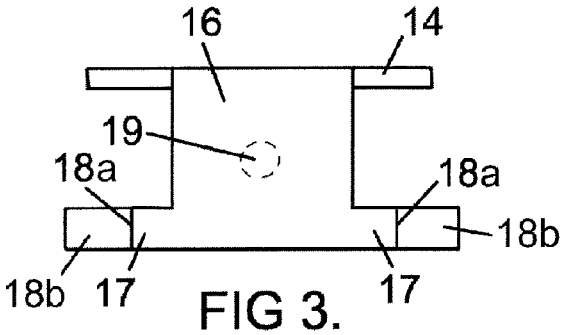
FIG. 3 is a view from behind of the tailpiece in FIG. 2.
Figure 4:
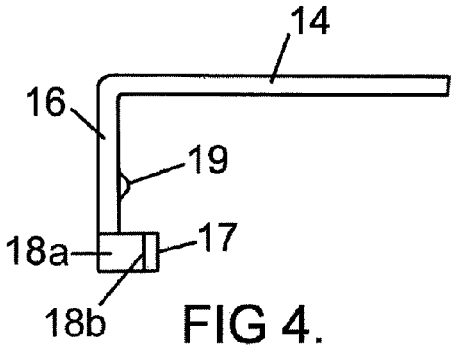
FIG. 4 is a side view of the tailpiece in FIG. 2.
Figure 5:
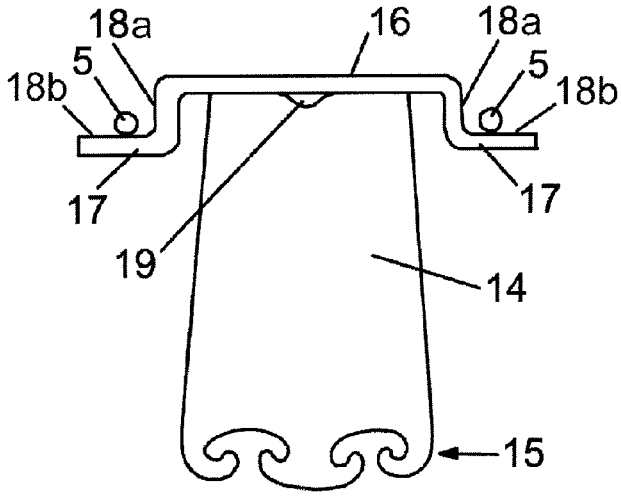
FIG. 5 is a view from below of the tailpiece in FIG. 2.
Figure 6:
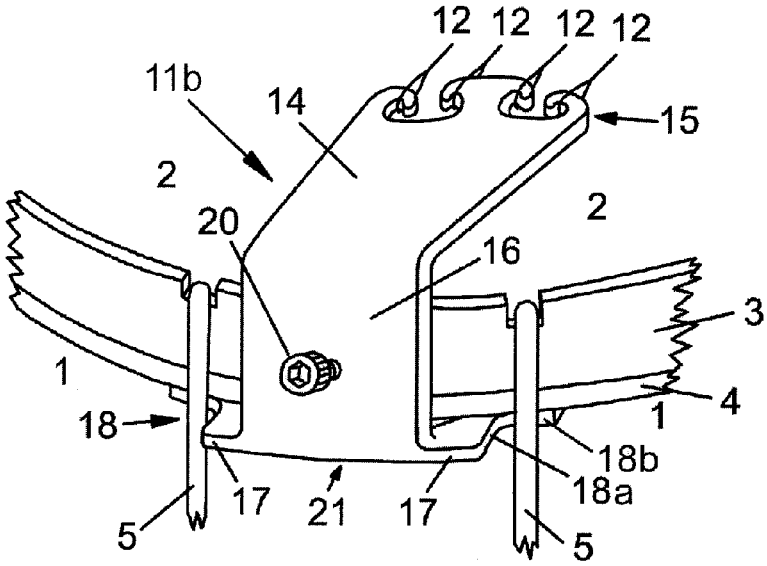
FIG. 6 is a perspective view of a second embodiment of the tailpiece of the invention.
Figure 7:
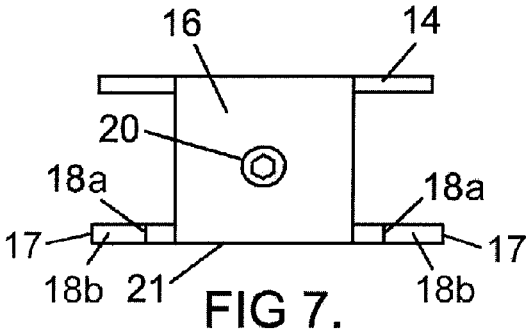
FIG. 7 is a view from behind of the tailpiece in FIG. 6.
Figure 8:
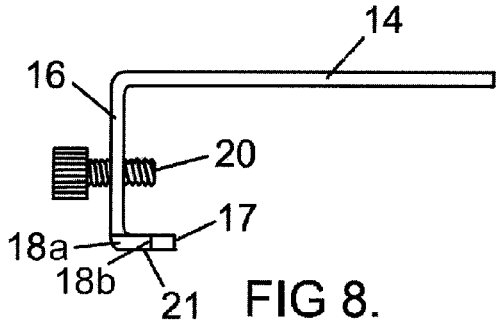
FIG. 8 is a side view of the tailpiece in FIG. 6.
Figure 9:
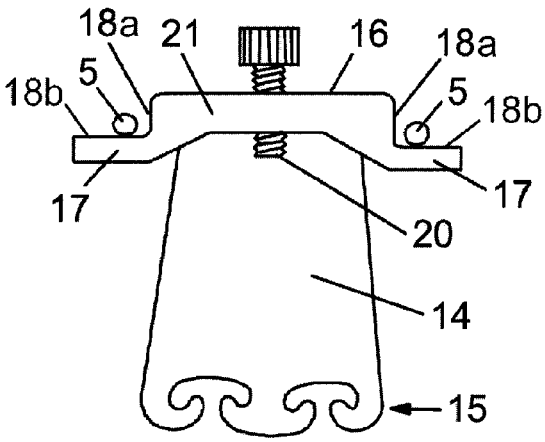
FIG. 9 is a view from below of the tailpiece in FIG. 6.

FIG. 1 illustrates the general structure of a banjo. It comprises a circular rim 1 over which is located a membrane or head 2 that is kept stretched over the rim 1 or a tone ring (not shown) mounted to the top of the rim 1, by means of a metallic tension ring 3 which is acting on a bottom edge 4 of the head 2 by means of a plurality of stretching hooks 5 distributed around the rim 1. The hooks 5 have an upper curved end which engages a respective recess in the tension ring 3, as can be seen in FIG. 2. The lower end of the stretching hooks 5 has a thread and extends through a hole in a perimeter flange on the rim 1. A respective nut (not shown) on the lower threaded end of the hooks 5 tightens the hook for pulling down the tension ring 3 and stretching the head 2. A neck 6 with a finger board 7 having frets 8 is attached to the rim 1. A peg head 9 holds tuning pegs 10 of the banjo. Strings 12 are attached to a tailpiece 11 and a respective tuning peg 10 and extend over a bridge 13.

FIGS. 2-5 illustrate in various views a first, basic embodiment of a tailpiece 11*a* of the present invention. It comprises a substantially L-shaped rigid member having an upper, substantially planar plate portion 14 and a rear, substantially planar plate portion 16 extending substantially normal to and downwardly from the first plate portion 14. The upper plate portion 14 has, at its forward, distal end hooks 15 for attachment of the strings 12 to the tailpiece 11*a*. At the lower distal end of the rear plate portion 16 two tailpiece fixation members 17 are formed integrally with the rear plate portion 16 and extend laterally from one another for engaging behind a respective one of two rear adjacent head-stretching hooks 5. Each fixation member 17 comprises an angled end section 18 having a first leg 18*a* protruding substantially forwardly and a second leg 18*b* extending substantially laterally for engagement with the respective stretching hook 5. The upper plate portion 14, the rear plate portion 16 and said fixation members 17 are preferably formed integrally into a rigid one-piece body.

The first leg 18*a* prevents the tailpiece 11*a* from being unintentionally uncoupled from the hooks 5 at both sides. Furthermore, since the distance between the two opposite outer side walls of the forwardly extending first legs 18*a* of the angled section 18 is shorter than the distance between the two rear adjacent stretching hooks 5, the tailpiece 11*a* can be laterally adjusted so that the strings 12 will be located at a proper position above the fingerboard 7.

The inside of the rear plate portion 16 may be provided with a forwardly projecting bulge 19 which lowers the point of contact of the tailpiece 11*a* with the tension ring 3 so that the torque exerted by the tension of the strings 12 increases thereby pressing the fixation members 17 harder against the hooks 5. Also, the upper edge surface of the angled section 18 of the fixation member engages the lower surface of the bottom edge 4 of the head 2 thereby limiting the height position of the tailpiece 11*a*. Thus, the tailpiece 11*a* has three points of contact located in a triangular configuration with a broad base; one central point at bulge 19, preferably against the lower part of the tension ring 3, and two points widely spaced, where the angled sections 18 of the fixation members 17 rest against the stretching hooks 5 and the bottom edge 4 of the head 2. This makes the tailpiece very stable in its position on the banjo.

The tailpiece 11*a* in FIGS. 2-5 consists of only one single piece which may be formed by bending a single piece of a metal plate or formed in a moulding process.

FIGS. 6-9 illustrate in various views a second embodiment of a tailpiece 11*b* of the present invention, where the bulge 19 in the first embodiment is replaced by an adjustment screw 20 which is inserted into a threaded hole in the rear plate portion 16. The distal end of the screw 20 rests against the lower part of the tension ring 3 which makes the distal end of the upper plate portion 14 of the tailpiece 11*b* adjustable also in height. In this second embodiment the fixation members 17 are in its entirety bent inwardly along the lower edge 21 to increase the strength of the tailpiece 11*b* when it is made of a thinner material. Here the leg 18*b* of the fixation member 17 function as a turning axis around which the tailpiece 11*b* can rotate by means of the adjustment screw 20. It should be noted that the adjustment screw 20 is located above said turning axis, which means that the upper plate portion 14 of the tailpiece is lifted from the head 2 when pressing the screw 20 against the tension ring 3. This is contrary to conventional adjustment screws of known tailpieces which lower the upper plate portion of the tailpiece towards the head in order to increase the pressure of the strings against the bridge. Therefore, the tailpiece 11*b* of the present invention can raise the upper portion of the tailpiece higher than conventional tailpieces resulting in a lower pressure being exerted by the strings on the bridge thereby allowing the bridge to vibrate more freely which increases the sound volume.

Owing to the fact that the tailpiece of the invention consists of one single component (except for the adjustment screw 20 in the second embodiment) it is inexpensive to manufacture, easy to install, reliable and easy to use. Due to the wide distance between the support points of the fixation member 17, 18 behind the adjacent stretching hooks 5, the position of the tailpiece will have unsurpassed stability in its mounted position.

What is claimed is:

1. A tailpiece for a banjo comprising:

a substantially L-shaped rigid member having a first, substantially planar plate portion and a second, substantially planar plate portion extending substantially normal to the first plate portion;

anchoring members on the L-shaped member for attachment of banjo strings to the tailpiece; and a fixation member at a distal end of the second plate portion for attachment of the tailpiece to a drum assembly of the banjo;

wherein said fixation member comprises two legs extending laterally away from one another, each of said legs being provided with a free end section configured for engaging behind a respective one of two adjacent banjo head-stretching hooks, said first and second plate portions and said fixation member being formed integrally into a rigid one-piece body.

2. The tailpiece of claim 1, wherein said free end section of the legs has a rear edge surface for engagement with a respective stretching hook, and an upper support surface for engagement with a lower edge surface of a banjo head mounting ring.

3. The tailpiece of claim 1, wherein said fixation member has two substantially parallel side edge surfaces facing away from one another, the distance between which being less than the mutual free distance between the two adjacent stretching hooks between which the tailpiece is to be mounted so as to allow for a lateral adjustment of the latter.

4. The tailpiece of claim 1, wherein said second plate portion is provided with a threaded hole for insertion of an adjustment screw for adjusting the vertical angle of the first plate portion of the tailpiece relative to the banjo head.

5. The tailpiece of claim 1, wherein said second plate portion is provided with a forwardly protruding bulge.

* * * * *